US009056228B2

(12) United States Patent
Ladd et al.

(10) Patent No.: US 9,056,228 B2
(45) Date of Patent: Jun. 16, 2015

(54) VARIABLE DENSITY CORE GOLF BALLS

(75) Inventors: Derek A. Ladd, Acushnet, MA (US); Michael J. Sullivan, Barrington, RI (US); Antonio U. DeSimas, East Providence, RI (US); Edmund A. Hebert, Mattapoisett, MA (US)

(73) Assignee: Acushnet Company, Fairhaven, MA (US)

( * ) Notice: Subject to any disclaimer, the term of this patent is extended or adjusted under 35 U.S.C. 154(b) by 429 days.

(21) Appl. No.: 13/539,689

(22) Filed: Jul. 2, 2012

(65) Prior Publication Data

US 2012/0270677 A1 Oct. 25, 2012

Related U.S. Application Data

(60) Division of application No. 12/358,293, filed on Jun. 19, 2009, now Pat. No. 8,235,845, which is a division of application No. 11/537,786, filed on Oct. 2, 2006, now Pat. No. 7,651,415, which is a continuation-in-part of application No. 11/191,087, filed on Jul. 27, 2005, now Pat. No. 7,452,291, which is a continuation-in-part of application No. 11/061,338, filed on Feb. 18, 2005, now Pat. No. 7,331,878, which is a continuation-in-part of application No. 10/773,906, filed on Feb. 6, 2004, now Pat. No. 7,255,656, which is a continuation-in-part of application No. 10/671,853, filed on Sep. 26, 2003, now Pat. No. 6,962,539, which is a (Continued)

(51) Int. Cl.
*A63B 37/06* (2006.01)
*A63B 37/00* (2006.01)

(52) U.S. Cl.
CPC ..... *A63B 37/0091* (2013.01); *A63B 37/0003* (2013.01); *A63B 37/0066* (2013.01); *A63B 37/0082* (2013.01)

(58) Field of Classification Search
CPC ..... A63B 37/0091; A63B 37/0035; A63B 37/0047; A63B 37/0066; A63B 37/0082
USPC ..... 473/373, 374
See application file for complete search history.

(56) References Cited

U.S. PATENT DOCUMENTS

| | | | | |
|---|---|---|---|---|
| 4,508,309 | A | 4/1985 | Brown | |
| 4,625,964 | A | 12/1986 | Yamada | |
| 4,863,167 | A | 9/1989 | Matsuki et al. | |
| 5,048,126 | A | 9/1991 | McLaughlin | |
| 5,048,838 | A | 9/1991 | Chikaraishi et al. | |
| 5,104,126 | A | 4/1992 | Gentiluomo | |
| 5,184,828 | A | 2/1993 | Kim et al. | |
| 5,273,286 | A | 12/1993 | Sun | |
| 5,334,673 | A | 8/1994 | Wu | |
| 5,482,285 | A | 1/1996 | Yabuki et al. | |
| 5,484,870 | A | 1/1996 | Wu | |
| 5,490,674 | A | 2/1996 | Hamada et al. | |
| 5,743,816 | A | 4/1998 | Ohsumi et al. | |
| 5,772,531 | A | 6/1998 | Ohsumi et al. | |
| 5,779,563 | A * | 7/1998 | Yamagishi et al. | 473/371 |
| 5,823,889 | A | 10/1998 | Aoyama | |
| 5,824,746 | A | 10/1998 | Harris et al. | |
| 5,833,553 | A | 11/1998 | Sullivan et al. | |
| 5,908,358 | A | 6/1999 | Wu | |
| 5,919,100 | A | 7/1999 | Boehm et al. | |
| 5,929,189 | A | 7/1999 | Ichikawa et al. | |

(Continued)

FOREIGN PATENT DOCUMENTS

WO WO 9952604 10/1999

*Primary Examiner* — Raeann Gorden
(74) *Attorney, Agent, or Firm* — Margaret C. Baker

(57) ABSTRACT

A golf ball is provided having a modified density gradient among the inner layers to produce a desired high or low moment of inertia and controlled spin rate is disclosed. The golf ball has three or more inner layers in addition to a cover, and the density of the inner layers is selected such that the layers inside the cover have a density progression from the core to the cover or from the cover to the core.

6 Claims, 2 Drawing Sheets

Related U.S. Application Data continuation-in-part of application No. 10/440,984, filed on May 19, 2003, now Pat. No. 6,995,191, which is a continuation of application No. 10/282,713, filed on Oct. 29, 2002, now Pat. No. 6,688,991, which is a continuation-in-part of application No. 09/815,753, filed on Mar. 23, 2001, now Pat. No. 6,494,795, application No. 13/539,689, which is a continuation-in-part of application No. 11/284,382, filed on Nov. 21, 2005, now Pat. No. 7,708,654, which is a continuation-in-part of application No. 11/191,087, filed on Jul. 27, 2005, now Pat. No. 7,452,291.

(56) References Cited

U.S. PATENT DOCUMENTS

| | | | | |
|---|---|---|---|---|
| 5,971,870 | A | | 10/1999 | Sullivan et al. |
| 6,010,412 | A | * | 1/2000 | Moriyama ..... 473/373 |
| 6,025,442 | A | | 2/2000 | Harris et al. |
| 6,056,842 | A | | 5/2000 | Dalton et al. |
| 6,057,403 | A | | 5/2000 | Sullivan et al. |
| 6,117,024 | A | | 9/2000 | Dewanjee |
| 6,120,393 | A | | 9/2000 | Sullivan et al. |
| 6,126,559 | A | | 10/2000 | Sullivan et al. |
| 6,142,887 | A | | 11/2000 | Sullivan et al. |
| 6,193,618 | B1 | | 2/2001 | Sullivan et al. |
| 6,210,294 | B1 | | 4/2001 | Wu |
| 6,302,808 | B1 | | 10/2001 | Dalton et al. |
| 6,309,313 | B1 | | 10/2001 | Peter |
| 6,309,314 | B1 | | 10/2001 | Sullivan et al. |
| 6,315,682 | B1 | | 11/2001 | Iwami et al. |
| 6,390,396 | B1 | | 5/2002 | Takano et al. |
| 6,390,935 | B1 | | 5/2002 | Sugimoto |
| 6,494,795 | B2 | | 12/2002 | Sullivan |
| 6,506,851 | B2 | | 1/2003 | Wu |
| 6,595,874 | B2 | | 7/2003 | Sullivan et al. |
| 6,653,382 | B1 | | 11/2003 | Statz et al. |
| 6,688,991 | B2 | | 2/2004 | Sullivan et al. |
| 6,692,380 | B2 | | 2/2004 | Sullivan et al. |
| 6,793,592 | B2 | | 9/2004 | Sullivan et al. |
| 6,852,042 | B2 | | 2/2005 | Sullivan et al. |
| 6,919,395 | B2 | | 7/2005 | Rajagopalan et al. |
| 6,953,403 | B2 | | 10/2005 | Sullivan et al. |
| 6,962,539 | B2 | | 11/2005 | Sullivan et al. |
| 6,995,191 | B2 | | 2/2006 | Sullivan et al. |
| 2002/0019268 | A1 | | 2/2002 | Tsunoda et al. |
| 2003/0130434 | A1 | | 7/2003 | Statz et al. |
| 2005/0027025 | A1 | | 2/2005 | Erb et al. |
| 2005/0049367 | A1 | | 3/2005 | Rajagopalan et al. |
| 2005/0059510 | A1 | | 3/2005 | Sullivan et al. |
| 2005/0124714 | A1 | | 6/2005 | Weikard et al. |

* cited by examiner

VARIABLE DENSITY CORE GOLF BALLS

CROSS-REFERENCE TO RELATED APPLICATIONS

The present application is a divisional application of patent application Ser. No. 12/358,293, filed Jun. 19, 2009, now U.S. Pat. No. 8,235,845, which is a divisional application of patent application Ser. No. 11/537,786, filed Oct. 2, 2006, now U.S. Pat. No. 7,651,415, which is a continuation in part of patent application Ser. No. 11/191,087 filed on Jul. 27, 2005 now U.S. Pat. No. 7,452,291, which is a continuation-in-part of patent application Ser. No. 11/061,338, filed on Feb. 18, 2005 now U.S. Pat. No. 7,331,878, which is a continuation-in-part of patent application Ser. No. 10/773,906 filed on Feb. 6, 2004 now U.S. Pat. No. 7,255,656, which is a continuation-in-part of patent application Ser. No. 10/671,853 filed on Sep. 26, 2003 now U.S. Pat. No. 6,962,539, which is a continuation-in-part of patent application Ser. No. 10/440,984 filed on May 19, 2003 now U.S. Pat. No. 6,995,191, which is a continuation of patent application Ser. No. 10/282,713 filed on Oct. 29, 2002 now U.S. Pat. No. 6,688,991, which is a continuation-in-part of patent application Ser. No. 09/815,753 filed on Mar. 23, 2001 now U.S. Pat. No. 6,494,795.

The present application is also a continuation-in-part of U.S. patent application Ser. No. 11/284,382 filed on Nov. 21, 2005, now U.S. Pat. No. 7,708,654, which is a continuation-in-part of U.S. application Ser. No. 11/191,087 filed on Jul. 27, 2005 now U.S. Pat. No. 7,452,291.

All parent patent applications and parent patents are incorporated herein by reference in their entireties.

FIELD OF THE INVENTION

This invention relates generally to a modified moment of inertia golf ball construction using varying specific gravity inner cores and intermediate layers.

BACKGROUND OF THE INVENTION

Conventional golf balls can be divided into two general types or groups: solid balls and wound balls. The difference in play characteristics resulting from these different constructions can be quite significant. These balls, however, have primarily two functional components that make them work. These components are the center or core and the cover. The primary purpose of the core is to be the "spring" of the ball or the principal source of resiliency. The cover protects the core and improves the spin characteristics of the ball.

Two-piece solid balls are made with a single-solid core, usually made of a cross-linked polybutadiene or other rubber, which is encased by a cover. These balls are typically the least expensive to manufacture as the number of components is low and these components can be manufactured by relatively quick, automated molding techniques. In these balls, the solid core is the "spring" or source of resiliency. The resiliency of the core can be increased by increasing the cross-linking density of the core material. As the resiliency increases, however, the compression also increases making a harder ball, which is undesirable. Recently, commercially successful golf balls, such as the Titleist Pro-V1 golf balls, have a relatively large polybutadiene based core, ionomer casing and polyurethane cover, for long distance when struck by the driver clubs and controlled greenside play.

The spin rate of golf balls is the end result of many variables, one of which is the distribution of the density or specific gravity within the ball. Spin rate is an important characteristic of golf balls for both skilled and recreational golfers. High spin rate allows the more skilled players, such as PGA professionals and low handicapped players, to maximize control of the golf ball. A high spin rate golf ball is advantageous for an approach shot to the green. The ability to produce and control back spin to stop the ball on the green and side spin to draw or fade the ball substantially improves the player's control over the ball. Hence, the more skilled players generally prefer a golf ball that exhibits high spin rate.

On the other hand, recreational players who cannot intentionally control the spin of the ball generally do not prefer a high spin rate golf ball. For these players, slicing and hooking are the more immediate obstacles. When a club head strikes a ball, an unintentional side spin is often imparted to the ball, which sends the ball off its intended course. The side spin reduces the player's control over the ball, as well as the distance the ball will travel. A golf ball that spins less tends not to drift off-line erratically if the shot is not hit squarely off the club face. The low spin ball will not cure the hook or the slice, but will reduce side spin and its adverse effects on play. Hence, recreational players prefer a golf ball that exhibits low spin rate.

Reallocating the density or specific gravity of the various layers or mantles in the ball is an important means of controlling the spin rate of golf balls. In some instances, weight from the outer portions of the ball is redistributed to the center of the ball to decrease the moment of inertia thereby increasing the spin rate. For example, U.S. Pat. No. 4,625,964 discloses a golf ball with a reduced moment of inertia having a core with specific gravity of at least 1.50 and a diameter of less than 32 mm and an intermediate layer of lower specific gravity between the core and the cover. U.S. Pat. No. 5,104,126 discloses a ball with a dense inner core having a specific gravity of at least 1.25 encapsulated by a lower density syntactic foam composition. U.S. Pat. No. 5,048,838 discloses another golf ball with a dense inner core having a diameter in the range of 15-25 mm with a specific gravity of 1.2 to 4.0 and an outer layer with a specific gravity of 0.1 to 3.0 less than the specific gravity of the inner core. U.S. Pat. No. 5,482,285 discloses another golf ball with reduced moment of inertia by reducing the specific gravity of an outer core to 0.2 to 1.0.

However, there remains a need for golf balls that fulfill specific needs of golfers in terms of spin rate or moment of inertia while maintaining the desired playing characteristics of distance, i.e., spring, and controllability.

SUMMARY OF THE INVENTION

Figure 1:
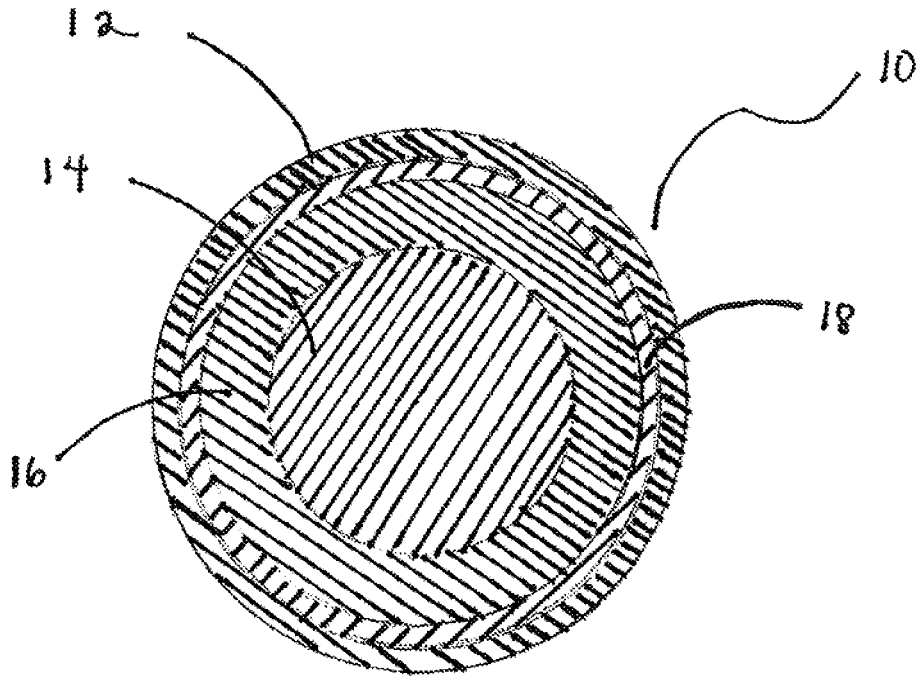
FIG. 1 is a cross-sectional view of a golf ball according to one embodiment of the invention.
Figure 2:
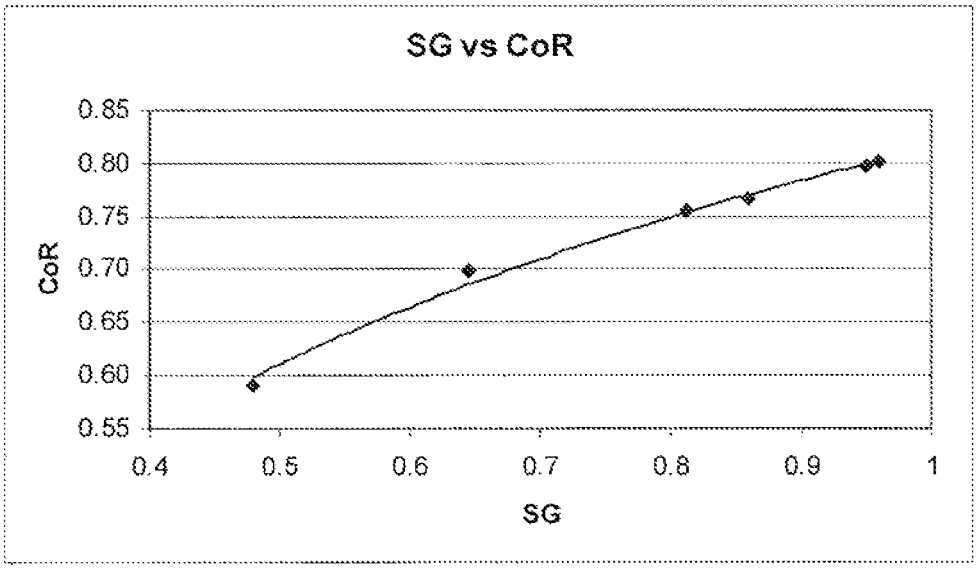
FIG. 2 is a graph of CoR versus specific gravity for 1 inch spheres.

The present invention is directed to multi-layered golf balls having a density gradient among the layers to establish the desired spin characteristics. This density gradient can increase from the outer layers to the inner layers inside the cover to produce a very low moment of inertia and a high spinning ball. Conversely, the density gradient can increase from the inner layers to the outer layers in side the cover to produce a very high moment of inertia and a low spinning ball.

DETAILED DESCRIPTION OF THE INVENTION

It is well known that the total weight of the ball has to conform to the weight limit set by the United States Golf Association ("USGA"). Redistributing the weight or mass of the ball either toward the center of the ball or toward the outer surface of the ball changes the dynamic characteristics of the ball at impact and in flight. Specifically, if the density is shifted or redistributed toward the center of the ball, the moment of inertia is reduced, and the initial spin rate of the ball as it leaves the golf club would increase due to lower resistance from the ball's moment of inertia. Conversely, if the density is shifted or redistributed toward or within the outer cover, the moment of inertia is increased, and the initial spin rate of the ball as it leaves the golf club would decrease due to the higher resistance from the ball's moment of inertia. The radial distance from the center of the ball or from the outer cover, where the moment of inertia switches from being increased to being decreased as a result of the redistribution of weight or mass density, is an important factor in golf ball design.

In accordance with one aspect of the present invention, this radial distance, hereinafter referred to as the centroid radius, is provided. When more of the ball's mass or weight is reallocated to the volume of the ball disposed between the center and the centroid radius, the moment of inertia is decreased, thereby producing a high spin ball. Hereafter, such a ball is referred as a low moment of inertia ball. When more of the ball's mass or weight is reallocated to the volume between the centroid radius and the outer cover, the moment of inertia is increased, thereby producing a low spin ball. Hereafter, such a ball is referred as a high moment of inertia ball.

The method for calculating centroid radius is fully disclosed in parent U.S. Pat. No. 6,494,795, which is incorporated by reference herein in its entirety. The results show that the centroid radius is located at approximately 0.65 inches radially from the center of a golf ball weighing 46 grams (1.62 ounce) and with a diameter of 1.68 inches, or 0.19 inches radially from the surface of the golf ball.

In accordance with the above calculations, the moment of inertia for a 1.62 oz golf ball having a diameter of about 1.68 inches with evenly distributed weight through any diameter is about 0.4572 oz·inch$^2$ (83.6 g·cm$^2$). Hence, golf balls with a moment of inertia higher than this value would be considered as high moment of inertia golf balls and balls with a lower value are considered as low moment of inertia golf balls. For example, a golf ball having a thin shell positioned at about 0.040 inch from the outer surface of the golf ball (or 0.8 inch from the center), has the following moments of inertia.

| Weight (oz) of Thin Shell | Moment of Inertia (oz · inch$^2$) | Moment of Inertia (g · cm$^2$) |
|---|---|---|
| 0.20 | 0.4861 | 88.9 |
| 0.405 | 0.5157 | 94.3 |
| 0.81 | 0.5742 | 102 |
| 1.61 | 0.6898 | 126.2 |

Low moment of inertia balls preferably have inertia of less than about 84 g·cm$^2$ and more preferably less than about 82 g·cm$^2$. High moment of inertia balls preferably have inertia of greater than about 84 g·cm$^2$ and more preferably greater than about 86 g·cm$^2$.

The inventive golf ball includes a cover and two or more inner layers. Suitable materials and formulations for the cover and various inner layers are discussed below. The density or specific gravity of each successive inner layer from either the center of the golf ball, to the cover, or from the cover to the center follows a predetermined gradient. In one embodiment the gradient is selected to be at least about 1.5 times and preferably about 2 times the density of the immediately preceding layer. Therefore, the densities of the inner layers of the golf ball either increase or decrease by a factor of 1.5 or 2 from layer to layer, producing a golf ball with an increased or decreased moment or inertia and the resultant spin rate properties. Although the cover layer can be included in the density progression, preferably, the inner layers are used to produce the desired moment of inertia of the golf ball, and the density of the cover is selected based upon the desired properties in the cover layer.

The inventive golf ball is formulated in accordance with the present invention to alter the moment of inertia of the golf ball. In an embodiment where there are three layers including a cover and two inners layers, the inner layers include a core and an intermediate layer. In an embodiment where the golf ball includes at least four layers including a cover layer and three or more inner layers, the inner layers include a core and two or more intermediate layers. The density of each successive layer from the core to the cover is least about 1.5 times and preferably at least about 2 times the density of the immediately preceding inner layer.

In one example embodiment, the golf ball includes a cover and three inner layers, and has the following properties, shown in Table I.

TABLE I

| Layer # | Dia (in) | Density (g/cm$^3$) | Mass (oz) | MOI g · cm$^2$ |
|---|---|---|---|---|
| Uniform Ball | | | | |
| 1 | 1.68 | 1.097 | 1.610153984 | 81.26812532 |
| | | | 1.610 | 81.27 |
| 3-Core Layer Ball "A" with Increasing Density | | | | |
| 1 | 1 | 0.480 | 0.152840372 | 2.657103325 |
| 2 | 1.53 | 1.030 | 0.824298011 | 42.10200704 |
| 3 | 1.58 | 3.570 | 0.394670864 | 28.90157167 |
| cover | 1.68 | 0.960 | 0.237692565 | 18.79210648 |
| | | | 1.610 | 92.45 |
| 3-Core Layer Ball "B" with Decreasing Density | | | | |
| 1 | 1 | 2.190 | 0.670379059 | 12.12303392 |
| 2 | 1.35 | 1.030 | 0.466298006 | 19.86491653 |
| 3 | 1.58 | 0.500 | 0.235787879 | 14.8425433 |
| cover | 1.68 | 0.960 | 0.237692565 | 18.79210648 |
| | | | 1.610 | 65.62 |

As shown in Table I, inventive ball "A" with the increasing density has an MOI of about 92.45 g·cm$^2$, which is about 14% higher than the MOI of the uniform ball. On the other hand, inventive ball "A" with the decreasing density has an MOI of about 65.62 g·cm$^2$, which is about 19% less than the MOI of the uniform ball. Preferably, one of layer #2 or #3 of ball "A" is a thin dense layer, discussed below. For ball "B", the specific gravity of the innermost core is at least about 1.75 and preferably at least about 2.0.

For example, as shown in FIG. 1, a golf ball 10 may comprise a cover 12 and three inner layers 14, 16, 18 wherein the specific gravity of the inner layers follows an increasing gradient from the center of the ball outward. Additionally, the specific gravity of the outermost inner layer 18 is at least about one and a half times the specific gravity of the adjacent inside inner layer 16. The innermost of the inner layers is core 14. Inner layer 18 of FIG. 1 is the thin dense layer, having a thickness from about 0.001 inch to about 0.050 inch and a diameter of from about 1.50 inch to about 1.64 inch. However, inner layer 16 may alternatively comprise the thin dense layer.

The specific gravity of the thin dense layer 18 of FIG. 1 is at least about 2.0. In another embodiment, the specific gravity of the thin dense layer 18 is at least about 3.0.

In general, for high moment of inertia embodiments, the innermost layer, i.e. the core, has a density of less than or equal to about 0.96 g/cc. Lowering the density of the innermost layer is accomplished by incorporating a density reducing filler. Suitable density reducing fillers are disclosed herein and include Expancel® 930 DUX 120, commercially available from Expancel of Stockviksverken, Sweden. Alternatively, the outer layers can also include density increasing fillers to achieve the desired density gradient or specific gravity gradient. Tables II and III illustrate changes in various properties for inner layer formulations of golf balls in accordance with the present invention based on the % of Expancel filler included in the layer.

TABLE II

| | Weight | Compression | Brigdestone Deflection | 130-10 Deflection | COR | SG |
|---|---|---|---|---|---|---|
| Control (no microsphere) | 7.93 | 107.7 | 4.30 | 4.26 | 0.801 | 0.960 |
| 1% microspheres | 7.84 | 104.9 | 4.34 | 4.37 | 0.797 | 0.950 |
| 2% microspheres | 7.04 | 30.9 | 6.00 | 6.51 | 0.766 | 0.860 |
| 3% microspheres | 6.08 | | 7.27 | 8.01 | 0.756 | 0.812 |
| 5% microspheres | 5.12 | | 12.06 | 11.74 | 0.700 | 0.646 |
| 10% microspheres | 3.89 | | 16.53 | 14.53 | 0.590 | 0.479 |

TABLE III

| | Weight Change | 130-10 Deflection Change | COR Change | SG Change |
|---|---|---|---|---|
| Control (no microsphere) | | | | |
| 1% microspheres | −1.1% | 2.6% | −0.5% | −1.0% |
| 2% microspheres | −11.2% | 52.7% | −4.4% | −10.4% |
| 3% microspheres | −23.4% | 88.0% | −5.7% | −15.4% |
| 5% microspheres | −35.4% | 175.6% | −12.7% | −32.7% |
| 10% microspheres | −50.9% | 241.1% | −26.3% | −50.1% |

In another embodiment, a golf ball is formulated in accordance with the present invention to decrease the moment of inertia of the golf ball and hence increase the spin rate of the golf ball. In one embodiment, the golf ball contains three layers including a cover, a core and an intermediate layer. The core has a core density that is at least about 8 times the intermediate layer density, preferably, at least about 10 times the intermediate layer density, more preferably at least about 12 times the intermediate layer density. In another embodiment, the golf ball includes four or more layers including a cover and three or more inner layers. These inner layers include a core and two or more intermediate layers. The inner layers are formulated such that the density of an inner layer is at least one and one half times and preferably twice the density of an adjacent outer layer. In general, the outermost inner layer, i.e., the inner layer disposed just under the cover, has a density of less than or equal to about 0.9 g/cc. Suitable formulations for achieving a layer having a reduced density are disclosed herein. In one embodiment, the outermost inner layer includes a density reducing filler such as Expancel.

Preferably, at least one of the layers is foamed, and is preferably a foamed highly neutralized polymer. The foamed layers can be an inner core, an outer core, a mantle layer or an inner cover. Suitable highly neutralized polymers and other suitable polymers for the innermost core and intermediate layer(s), as well as suitable polymers for the other ball layers, are discussed in detail below.

The core, intermediate layer(s) and cover layer(s) of the present invention may be made from any materials including, but are not limited to, highly-neutralized polymers and blends thereof. Other suitable compositions include, but are not limited to, thermoplastic or thermoset compositions.

As discussed above, highly neutralized polymers are preferred for some of the embodiments. Generally, a highly neutralized polymer is formed from a reaction between acid groups on a polymer, a suitable source of cation, and an organic acid or the corresponding salt, and the extent of neutralization is at least 80%, preferably at least 90%, and more preferably 100%. Suitable source of cation is selected from magnesium, sodium, zinc, lithium, potassium and calcium, and the organic acid or the corresponding salt is selected from oleic acid, salt of oleic acid, stearic acid, salt of stearic acid, behenic acid, salt of behenic acid or combination thereof. Highly neutralized polymers are fully disclosed in commonly owned co-pending U.S. published patent publication number 2005/0049367, which is incorporated herein by reference in its entirety.

Additionally, the compositions of U.S. application Ser. No. 10/269,341, now U.S. Publication No. 2003/0130434, and U.S. Pat. No. 6,653,382, both of which are incorporated herein in their entirety, discuss compositions having high coefficient of restitution (CoR) when formed into solid spheres.

The thermoplastic composition of this invention preferably comprises (a) aliphatic, mono-functional organic acid(s) having fewer than 36 carbon atoms; and (b) ethylene, $C_3$ to $C_8$ $\alpha,\beta$-ethylenically unsaturated carboxylic acid copolymer(s) and ionomer(s) thereof, wherein greater than 90%, preferably near 100%, and more preferably 100% of all the acid of (a) and (b) are neutralized.

The thermoplastic composition preferably comprises melt-processible, highly-neutralized (greater than 90%, preferably near 100%, and more preferably 100%) polymer of (1) ethylene, $C_3$ to $C_8$ $\alpha,\beta$-ethylenically unsaturated carboxylic acid copolymers that have their crystallinity disrupted by addition of a softening monomer or other means such as high acid levels, and (2) non-volatile, non-migratory agents such as organic acids (or salts) selected for their ability to substantially or totally suppress any remaining ethylene crystallinity. Agents other than organic acids (or salts) may be used.

Highly neutralized thermoplastic polymer may also comprise a copolymer of ethylene and an $\alpha$, $\beta$-unsaturated carboxylic acid or a terpolymer of ethylene, an $\alpha$, $\beta$-unsaturated carboxylic acid, and an n-alkyl acrylate, the acid being at least 80% neutralized by a salt of an organic acid, a cation source, or a suitable base of the organic acid. The highly neutralized polymer may be fully neutralized by a salt of an organic acid, a cation source or a suitable base of the organic acid.

It has been found that, by modifying an acid copolymer or ionomer with a sufficient amount of specific organic acids (or salts thereof); it is possible to highly neutralize the acid copolymer without losing processibility or properties such as elongation and toughness. The organic acids employed in the present invention are aliphatic, mono-functional, saturated or unsaturated organic acids, particularly those having fewer than 36 carbon atoms, and particularly those that are non-volatile and non-migratory and exhibit ionic array plasticizing and ethylene crystallinity suppression properties.

With the addition of sufficient organic acid, greater than 90%, nearly 100%, and preferably 100% of the acid moieties in the acid copolymer from which the ionomer is made can be neutralized without losing the processibility and properties of elongation and toughness.

The melt-processible, highly-neutralized acid copolymer ionomer can be produced by the following:

(a) melt-blending (1) ethylene α,β-ethylenically unsaturated $C_{3-8}$ carboxylic acid copolymer(s) or melt-processible ionomer(s) thereof (ionomers that are not neutralized to the level that they have become intractable, that is not melt-processible) with (1) one or more aliphatic, mono-functional, saturated or unsaturated organic acids having fewer than 36 carbon atoms or salts of the organic acids, and then concurrently or subsequently (b) adding a sufficient amount of a cation source to increase the level of neutralization all the acid moieties (including those in the acid copolymer and in the organic acid) to greater than 90%, preferably near 100%, more preferably to 100%.

Preferably, highly-neutralized thermoplastics of the invention can be made by:

(a) melt-blending (1) ethylene, α,β-ethylenically unsaturated $C_{3-8}$ carboxylic acid copolymer(s) or melt-processible ionomer(s) thereof that have their crystallinity disrupted by addition of a softening monomer or other means with (2) sufficient non-volatile, non-migratory agents to substantially remove the remaining ethylene crystallinity, and then concurrently or subsequently (b) adding a sufficient amount of a cation source to increase the level of neutralization all the acid moieties (including those in the acid copolymer and in the organic acid if the non-volatile, non-migratory agent is an organic acid) to greater than 90%, preferably near 100%, more preferably to 100%.

The acid copolymers used in the present invention to make the ionomers are preferably 'direct' acid copolymers. They are preferably alpha olefin, particularly ethylene, $C_{3-8}$ α,β-ethylenically unsaturated carboxylic acid, particularly acrylic and methacrylic acid, copolymers. They may optionally contain a third softening monomer. By "softening," it is meant that the crystallinity is disrupted (the polymer is made less crystalline). Suitable "softening" comonomers are monomers selected from alkyl acrylate, and alkyl methacrylate, wherein the alkyl groups have from 1-8 carbon atoms.

The acid copolymers, when the alpha olefin is ethylene, can be described as E/X/Y copolymers where E is ethylene, X is the α,β-ethylenically unsaturated carboxylic acid, and Y is a softening comonomer. X is preferably present in 3-30 (preferably 4-25, most preferably 5-20) wt. % of the polymer, and Y is preferably present in 0-30 (alternatively 3-25 or 10-23) wt. % of the polymer.

Spheres were prepared using fully neutralized ionomers A and B.

TABLE IV

| Sample | Resin Type (%) | Acid Type (%) | Cation (% Neut*) | M.I. (g/10 min) |
|---|---|---|---|---|
| 1A | A (60) | Oleic (40) | Mg (100) | 1.0 |
| 2B | A (60) | Oleic (40) | Mg (105)* | 0.9 |
| 3C | B (60) | Oleic (40) | Mg (100) | 0.9 |
| 4D | B (60) | Oleic (40) | Mg (105)* | 0.9 |
| 5E | B (60) | Strearic (40) | Mg (100) | 0.85 |

A - 76.9% ethylene, 14.8% normal butyl acrylate, 8.3% acrylic acid

B - 75% ethylene, 14.9% normal butyl acrylate, 10.1% acrylic acid

*indicates that cation was sufficient to neutralize 105% of all the acid in the resin and the organic acid.

These compositions were molded into 1.53-inch spheres for which data is presented in the following table.

TABLE V

| Sample | Atti Compression | COR @ 125 ft/s |
|---|---|---|
| 1A | 75 | 0.826 |
| 2B | 75 | 0.826 |
| 3C | 78 | 0.837 |
| 4D | 76 | 0.837 |
| 5E | 97 | 0.807 |

Further testing of commercially available highly neutralized polymers HNP1 and HNP2 had the following properties.

TABLE VI

| Material Properties | HNP1 | HNP2 |
|---|---|---|
| Specific Gravity (g/cm.sup.3) | 0.966 | 0.974 |
| Melt Flow, 190.degree. C., 10-kg load | 0.65 | 1.0 |
| Shore D Flex Bar (40 hr) | 47.0 | 46.0 |
| Shore D Flex Bar (2 week) | 51.0 | 48.0 |
| Flex Modulus, psi (40 hr) | 25,800 | 16,100 |
| Flex Modulus, psi (2 week) | 39,900 | 21,000 |
| DSC Melting Point (.degree. C.) | 61.0 | 61/101 |
| Moisture (ppm) | 1500 | 4500 |
| Weight % Mg | 2.65 | 2.96 |

TABLE VII

Solid Sphere Data

| Material | HNP1 | HNP2 | HNP2a | HNP1a | HNP1a/HNP2a (50:50 blend) |
|---|---|---|---|---|---|
| Spec. Grav. | 0.954 | 0.959 | 1.153 | 1.146 | 1.148 |
| Filler | None | None | Tungsten | Tungsten | Tungsten |
| Compression | 107 | 83 | 86 | 62 | 72 |
| COR | 0.827 | 0.853 | 0.844 | 0.806 | 0.822 |
| Shore D | 51 | 47 | 49 | 42 | 45 |
| Shore C | | | 79 | 72 | 75 |

These materials are exemplary examples of the preferred center and/or core layer compositions of the present invention. They may also be used as a cover layer herein. The golf ball components of the present invention, in particular the core (center and/or outer core layers) may be formed from a co-polymer of ethylene and an α,β-unsaturated carboxylic acid. In another embodiment, they may be formed from a terpolymer of ethylene, an α,β-unsaturated carboxylic acid, and an n-alkyl acrylate. Preferably, the α,β-unsaturated carboxylic acid is acrylic acid or methacrylic acid. In a preferred embodiment, the n-alkyl acrylate is n-butyl acrylate. Further, in a preferred form, the co- or ter-polymer comprises a level of fatty acid salt greater than 5 phr of the base resin. The preferred fatty acid salt is magnesium oleate or magnesium stearate.

It is highly preferred that the carboxylic acid in the intermediate layer is 100% neutralized with metal ions. The metal ions used to neutralize the carboxylic acid may be any metal ion known in the art. Preferably, the metal ions comprise magnesium ions. If the material used in the intermediate layer is not 100% neutralized, the resultant resilience properties such as CoR and initial velocity may not be sufficient to produce the improved initial velocity and distance properties of the present invention.

The golf ball components can comprise various levels of the three components of the co- or terpolymer as follows: from about 60 to about 90% ethylene, from about 8 to about 20% by weight of the α,β-unsaturated carboxylic acid, and from 0% to about 25% of the n-alkyl acrylate. The co- or terpolymer may also contain an amount of a fatty acid salt. The fatty acid salt preferably comprises magnesium oleate. These materials are commercially available from DuPont, under the tradename DuPont HPF®.

In one embodiment, the core and/or core layers (or other intermediate layers) comprises a copolymer of about 81% by weight ethylene and about 19% by weight acrylic acid, wherein 100% of the carboxylic acid groups are neutralized with magnesium ions. The copolymer also contains at least 5 phr of magnesium oleate. Material suitable for use as this layer is available from DuPont under the tradename DuPont HPF SEP 1313-4®.

In another preferred embodiment, the core and/or core layers (or other intermediate layers) comprise a copolymer of about 85% by weight ethylene and about 15% by weight acrylic acid, wherein 100% of the acid groups are neutralized with magnesium ions. The copolymer also contains at least 5 phr of magnesium oleate. Material suitable for use as this layer is available from DuPont under the tradename DuPont HPF SEP 1313-3®.

In another preferred embodiment, the core and/or core layers (or other intermediate layers) comprise a copolymer of about 88% by weight ethylene and about 12% by weight acrylic acid, wherein 100% of the acid groups are neutralized with magnesium ions. The copolymer also contains at least 5 phr of magnesium oleate. Material suitable for use as this layer is available from DuPont under the tradename DuPont HPF AD1027®.

In a further preferred embodiment, the core and/or core layers (or other intermediate layers) are adjusted to a target specific gravity to enable the ball to be balanced. For a 1.68-inch diameter golf ball having a ball weight of about 1.61 oz, the target specific gravity is about 1.125. It will be appreciated by one of ordinary skill in the art that the target specific gravity will vary based upon the size and weight of the golf ball. The specific gravity is adjusted to the desired target through the use of inorganic fillers. Preferred fillers used for compounding the inner layer to the desired specific gravity include, but are not limited to, tungsten, zinc oxide, barium sulfate and titanium dioxide. Other suitable fillers, in particular nano or hybrid materials, include those described in U.S. Pat. Nos. 6,793,592 and 6,919,395, which are incorporated herein in their entirety.

Some preferred golf ball layers formed from the above compositions were molded onto a golf ball center using DuPont HPF RX-85®, Dupont HPF SEP 1313-3®, or DuPont HPF SEP 1313-4®. DuPont HPF RX-85®, a copolymer of about 88% ethylene and about 12% acrylic acid, wherein 100% of the acid groups are neutralized with magnesium ions. Further, the copolymer contains a fixed amount of magnesium oleate. This material was compounded to a specific gravity of about 1.125 using tungsten. The Shore D hardness of this material (as measured on the curved surface of the inner cover layer) was about 58 to about 60. DuPont HPF SEP 1313-3®, a copolymer of about 85% ethylene and about 15% acrylic acid, wherein 100% of the acid groups are neutralized with magnesium ions. Further, the copolymer contains a fixed amount of magnesium oleate. This material was compounded to a specific gravity of about 1.125 using tungsten. The Shore D hardness of this material (as measured on the curved surface of the inner cover layer) was about 58-60. DuPont HPF SEP 1313-4®, a copolymer of about 81% ethylene and about 19% acrylic acid, wherein 100% of the acid groups are neutralized with magnesium ions. Further, the copolymer contains a fixed amount of magnesium oleate. This material was compounded to a specific gravity of about 1.125 using tungsten. The Shore D hardness of this material (as measured on the curved surface of the inner cover layer) was about 58-60.

The centers/cores/layers can also comprise various levels of the three components of the terpolymer as follows: from about 60% to 80% ethylene; from about 8% to 20% by weight of the α,β-unsaturate-d carboxylic acid; and from about 0% to 25% of the n-alkyl acrylate, preferably 5% to 25%. The terpolymer will also contain an amount of a fatty acid salt, preferably magnesium oleate. These materials are commercially available under the trade name DuPont® HPF™. In a preferred embodiment, a terpolymer suitable for the invention will comprise from about 75% to 80% by weight ethylene, from about 8% to 12% by weight of acrylic acid, and from about 8% to 17% by weight of n-butyl acrylate, wherein all of the carboxylic acid is neutralized with magnesium ions, and comprises at least 5 phr of magnesium oleate.

In another preferred embodiment, the cover layer will comprise a terpolymer of about 70% to 75% by weight ethylene, about 10.5% by weight acrylic acid, and about 15.5% to 16.5% by weight n-butyl acrylate. The acrylic acid groups are 100% neutralized with magnesium ions. The terpolymer will also contain an amount of magnesium oleate. Materials suitable for use as this layer are sold under the trade name DuPont® HPF™ AD 1027.

In yet another preferred embodiment, the centers/cores/layers comprise a copolymer comprising about 88% by weight of ethylene and about 12% by weight acrylic acid, with 100% of the acrylic acid neutralized by magnesium ions. The centers/cores/layers may also contain magnesium oleate. Material suitable for this embodiment was produced by DuPont as experimental product number SEP 1264-3. Preferably the centers/cores/layers are adjusted to a target specific gravity of 1.125 using inert fillers to adjust the density with minimal effect on the performance properties of the cover layer. Preferred fillers used for compounding the centers/cores/layers to the desired specific gravity include but are not limited to tungsten, zinc oxide, barium sulfate, and titanium dioxide.

Suitable highly neutralized polymers further include those disclosed in United States published patent application numbers 2005/0049367 and 2005/01247141, which are incorporated by reference herein in their entireties.

In one example, an inventive ball is made by forming a first set of intermediate layers were molded onto cores using DuPont® HPF™ AD1027, which is a terpolymer of about 73% to 74% ethylene, about 10.5% acrylic acid, and about 15.5% to 16.5% n-butyl acrylate, wherein 100% of the acid groups are neutralized with magnesium ions. Further, the terpolymer contains a fixed amount of greater than 5 phr magnesium oleate. This material is compounded to a specific gravity of about 1.125 using barium sulfate and titanium dioxide. The Shore D hardness of this material (as measured on the curved surface of the inner cover layer) is about 58-60. These materials are readily foamable.

A second set of layers were molded onto each of the experimental cores using DuPont experimental HPF™ SEP 1264-3, which is a copolymer of about 88% ethylene and about 12% acrylic acid, wherein 100% of the acid groups are neutralized with magnesium ions. Further, the copolymer contains a fixed amount of at least 5 phr magnesium oleate. This material is compounded to a specific gravity of about 1.125 using zinc oxide. The Shore D hardness of this material (as measured on the curved surface of the inner cover layer) is about 61-64.

A first set of covers were molded onto each of the core/layer components using DuPont HPF™ 1000, which is a terpolymer of about 75% to 76% ethylene, about 8.5% acrylic acid, and about 15.5% to 16.5% n-butyl acrylate, wherein 100% of the acid groups are neutralized with magnesium ions. Further, the terpolymer contains a fixed amount of at least 5 phr of magnesium stearate. This material is compounded to a target specific gravity of about 1.125 using barium sulfate and titanium dioxide. The Shore D hardness of this material (as measured on the curved surface of the molded golf ball) is about 60-62.

It should be understood, especially to one of ordinary skill in the art, that there is a fundamental difference between "material hardness" and "hardness, as measured directly on a golf ball." Material hardness is defined by the procedure set forth in ASTM-D2240 and generally involves measuring the hardness of a flat "slab" or "button" formed of the material of which the hardness is to be measured. Hardness, when measured directly on a golf ball (or other spherical surface) is a completely different measurement and, therefore, results in a different hardness value. This difference results from a number of factors including, but not limited to, ball construction (i.e., core type, number of core and/or cover layers, etc.), ball (or sphere) diameter, and the material composition of adjacent layers. It should also be understood that the two measurement techniques are not linearly related and, therefore, one hardness value cannot easily be correlated to the other.

The moment of inertia is typically measured on model number MOI-005-104 Moment of Inertia Instrument manufactured by Inertia Dynamics of Collinsville, Conn. The instrument is plugged into a PC for communication via a COMM port and is driven by MOI Instrument Software version #1.2.

The highly neutralized polymers can be foamed by any known methods. Typical physical foaming/blowing agents include volatile liquids such as freons (CFCs), other halogenated hydrocarbons, water, aliphatic hydrocarbons, gases, and solid blowing agents, i.e., compounds that liberate gas as a result of desorption of gas. Preferably, the blowing agent includes an adsorbent. Typical adsorbents include, for example, activated carbon, calcium carbonate, diatomaceous earth, and silicates saturated with carbon dioxide.

Chemical foaming/blowing agents are more preferred, particularly when the core includes thermoplastics such as ionomers, highly neutralized polymers, and polyolefins. Chemical blowing agents may be inorganic, such as ammonium carbonate and carbonates of alkalai metals, or may be organic, such as azo and diazo compounds, such as nitrogen-based azo compounds. Suitable azo compounds include, but are not limited to, 2,2'-azobis(2-cyanobutane), 2,2'-azobis (methylbutyronitrile), azodicarbonamide, p,p'-oxybis(benzene sulfonyl hydrazide), p-toluene sulfonyl semicarbazide, p-toluene sulfonyl hydrazide. Other blowing agents include any of the Celogens® sold by Crompton Chemical Corporation, and nitroso compounds, sulfonylhydrazides, azides of organic acids and their analogs, triazines, tri-and tetrazole derivatives, sulfonyl semicarbazides, urea derivatives, guanidine derivatives, and esters such as alkoxyboroxines. Other possible blowing agents include agents that liberate gasses as a result of chemical interaction between components such as mixtures of acids and metals, mixtures of organic acids and inorganic carbonates, mixtures of nitriles and ammonium salts, and the hydrolytic decomposition of urea.

Alternatively, low specific gravity can be achieved by incorporating low density fillers or agents such as hollow fillers or microspheres in the polymeric matrix, where the cured composition has the preferred specific gravity. Alternatively, the polymeric matrix can be foamed to decrease its specific gravity, microballoons, or other low density fillers as described in U.S. Pat. No. 6,692,380 and '795 patent. The '380 patent is incorporated by reference in its entirety.

Additionally, BASF polyurethane materials sold under the trade name Cellasto® and Elastocell®, microcellular polyurethanes, Elastopor® H that is a closed-cell polyurethane rigid foam, Elastoflex® W flexible foam systems, Elastoflex® E semiflexible foam systems, Elastofoam® flexible integrally-skinning systems, Elastolit® D/K/R integral rigid foams, Elastopan® S, Elastollan® thermoplastic polyurethane elastomers (TPUs), and the like are all applicable to the present invention. Bayer (laxness) also produces a variety of materials sold as Texin® TPUs, Baytec® and Vulkollan® elastomers, Baymer® rigid foams, Baydur® integral skinning foams, Bayfit® flexible foams available as castable, RIM grades, sprayable, and the like.

Additional materials that may be applicable herein include polyisocyanurate foams and a variety of "thermoplastic" foams, which may be cross-linked to varying extents using free-radical (e.g., peroxide) or radiation cross-linking (e.g., UV, IR, Gamma, EB). Also suitable are polybutadiene, polystyrene, polyolefin (including metallocene and other single site catalyzed polymers), ethylene vinyl acetate (EVA), acrylate copolymers, such as EMA, EBA, nucrel® type acid co and terpolymers, ethylene propylene rubber (such as EPR, EPDM, and any ethylene copolymers), styrene-butadiene, SEBS (any Kraton-type), PVC, PVDC, CPE (chlorinated polyethylene), epoxy foams, urea-formaldehyde foams, latex foams and sponge, silicone foams, flouorpolymer foams and syntactic foams (hollow sphere filled).

An alternative to chemical or physical foaming is the use of specific-gravity-lowering fillers, fibers, flakes, spheres, or hollow microspheres or microballoons, such as 3M glass (glass bubbles), ceramic (zeospheres), phenolic, as well as other polymer based compositions, such as acrylonitrile, PVDC, and the like.

Suitable foaming agents include expandable micro spheres. Exemplary microspheres consist of an acrylonitrile polymer shell encapsulating a volatile gas, such as isopentane gas. This gas is contained within the sphere as a blowing agent. In their unexpanded state, the diameter of these hollow spheres range from 10 to 17 μm and have a true density of 1000 to 1300 kg/m$^3$.

When heated, the gas inside the shell increases its pressure and the thermoplastic shell softens, resulting in a dramatic increase of the volume of the microspheres. Fully expanded, the volume of the microspheres will increase more than 40 times (typical diameter values would be an increase from 10 to 40μm), resulting in a true density below 30 kg/m$^3$ (0.25 lbs/gallon). Typical expansion temperatures range from 80-190° C. (176-374° F.). Such expandable microspheres are commercially available as EXPANCEL® from Expancel of Sweeden or Akzo Nobel.

In this application, these microspheres are reacted during the molding process of the part, using the elevated molding temperatures to activate the gas. By initially reducing the volume of component material loaded in the mold, the process relies on the expansion of the microspheres to fill the remainder of space within the cavity during the molding cycle. The dynamic in-mold expansion of the microspheres reduces the density of the material as it fills the volume of the mold, maximizing the potential of the microspheres while minimizing the amount of material required to produce the low-density component.

As discussed in parent application Ser. No. 11/191,087, which is incorporated by reference in its entirety above, one-inch spheres are made from a highly neutralized polymer and EXPANCEL® 092 MB 120 expandable microspheres. The particular microspheres used have outer shells made from copolymers of ethylene vinylacetate. The one-inch spheres tested as follows:

TABLE VIII

| | Weight | Compression | Bridgestone Deflection | 130-10 Deflection | COR | SG |
|---|---|---|---|---|---|---|
| Control (no microsphere) | 7.93 | 107.7 | 4.30 | 4.26 | 0.801 | 0.960 |
| 1% microspheres | 7.84 | 104.9 | 4.34 | 4.37 | 0.797 | 0.950 |
| 2% microspheres | 7.04 | 30.9 | 6.00 | 6.51 | 0.766 | 0.860 |
| 3% microspheres | 6.08 | | 7.27 | 8.01 | 0.756 | 0.812 |
| 5% microspheres | 5.12 | | 12.06 | 11.74 | 0.700 | 0.646 |
| 10% microspheres | 3.89 | | 16.53 | 14.53 | 0.590 | 0.479 |

TABLE IX

| | Weight Change | 130-10 Deflection Change | COR Change | SG Change |
|---|---|---|---|---|
| Control (no microsphere) | | | | |
| 1% microspheres | −1.1% | 2.6% | −0.5% | −1.0% |
| 2% microspheres | −11.2% | 52.7% | −4.4% | −10.4% |
| 3% microspheres | −23.4% | 88.0% | −5.7% | −15.4% |
| 5% microspheres | −35.4% | 175.6% | −12.7% | −32.7% |
| 10% microspheres | −50.9% | 241.1% | −26.3% | −50.1% |

As shown in the above data, inclusion of microspheres reduces the weight of the one-inch spheres, which can be used as a core layer, an intermediate layer or other layer in the golf ball. Such reduction in weight in an intermediate layer allows more weight to be placed on the outer layers, such as in a thin dense layer, to provide balls with high moment of inertia. Preferably, the thin dense layer has a specific gravity of at least about 1.5 and a thickness from about 0.001 inch to about 0.050 inch and a diameter from about 1.50 inch to about 1.64 inch. The specific gravity of the thin dense layer can be at least 2.0 or at least about 3.0. The thickness of the thin dense layer can be from about 0.005 inch to about 0.030 inch or more preferably from about 0.010 inch to about 0.020 inch. Thin dense layers are fully disclosed in parent application Ser. No. 09/815,753 now U.S. Pat. No. 6,494,795, previously incorporated by reference in its entirety, and in commonly owned U.S. Pat. No. 6,852,042, which is incorporated by reference herein in its entirety.

Alternatively, more weight can be placed in the innermost core to provide low moment of inertia balls. Ten percent (10%) of microspheres produce about 50% change in weight and specific gravity. Inclusion of micro spheres also increases deflection and decreases compression. The data also shows that so long as the weight or specific gravity changes are less than about 25% and 15%, respectively, the decrease in CoR is less than about 6%. The decrease in CoR of one layer can be compensated by a high compression core, intermediate or inner cover.

Additionally, the inventors also discovered that there is a relationship between the CoR and the specific gravity in this experiment with one-inch spheres, as shown in the graph in FIG. 1.

The relationship between CoR and specific gravity can be represented by the following equations:

$$CoR=0.2947\ \ln(SG)+0.8148,\ \text{or}$$

$$SG=0.0644\ e^{(3.3624\cdot COR)}.$$

The coefficient of determination, R, is calculated to be: R=0.9908. This relationship is representative of the foamed materials used and may vary under different testing conditions.

This relationship should also hold when the same highly neutralized polymer with EXPANCEL® 092 MB 120 expandable microspheres is used as the intermediate layer, an outer core or an inner cover.

In one exemplary embodiment, a subassembly comprising an unfoamed inner core made from the same HNP used in the previous TABLES, i.e., the control samples, and an intermediate layer made from the same HNP with EXPANCEL® 092 MB 120 expandable microspheres. In this example, the subassembly has a total diameter of about 1.45 inches and the intermediate layer has a thickness of about 0.085 inch. The specific gravities and COR of the sub-assembly calculated from the linear equation in GRAPH I are shown below.

TABLE X

| | SG-Core | SG-Inter | SG-Subass'y[1] | SG Change | COR-Subass'y[2] | COR Change |
|---|---|---|---|---|---|---|
| Control (no microsphere) | 0.960 | 0.960 | 0.960 | — | 0.803 | — |
| 1% microspheres | 0.960 | 0.950 | 0.958 | −0.002(0.2%) | 0.802 | −0.001(.1%) |
| 2% microspheres | 0.960 | 0.860 | 0.943 | −0.017(1.8%) | 0.797 | −0.005(.6%) |
| 3% microspheres | 0.960 | 0.812 | 0.935 | −0.025(2.6%) | 0.795 | −0.008(1%) |
| 5% microspheres | 0.960 | 0.646 | 0.908 | −0.052(5.4%) | 0.786 | −0.017(2%) |

TABLE X-continued

| | SG-Core | SG-Inter | SG-Subass'y[1] | SG Change | COR-Subass'y[2] | COR Change |
|---|---|---|---|---|---|---|
| 10% microspheres | 0.960 | 0.479 | 0.880 | −0.080(8.3%) | 0.777 | −0.026(3%) |

[1]the specific gravity of the subassembly is the weighted average of the SG of the core and the SG of the intermediate layer based on their respective volumes. The volume of the subassembly is 12.77 $inch^3$; the volume of the intermediate layer is 2.12 $inch^3$; and the volume of the inner core is 10.65 $inch^3$.
[2]the CoR of the subassembly is calculated by substituting the specific gravity of the subassembly into the linear equation derived from GRAPH 1. The difference between the CoR for the controls between Table VII and Table V is probably caused by the uncertainty introduced by the necessary estimation and round-off errors in preparing GRAPH 1.

The data suggests that a golf ball or a sub-assembly thereof with an intermediate layer having a thickness in the range of about 0.1 inch can have the specific gravity of the intermediate layer reduced significantly, e.g., at least 30% or even 50% without having to incur a significant loss in CoR, i.e., about 3% or less of CoR. Alternatively, the specific gravity of the entire subassembly can be reduced up to about 8% without incurring a significant loss in CoR.

In accordance to another aspect of the present invention, as discussed in patent application Ser. No. 10/974,144, which is also commonly owned, co-pending published patent application US2005/0059510, when the club strikes the ball a portion of the core is deformed by the impact. This deformation zone is responsible for most if not substantially all of the rebounding of the ball. Hence, when an intermediate layer, such as an outer core, encases an inner core and the intermediate layer has sufficient thickness, then the CoR of this subassembly is controlled by, or is substantially the same as the CoR of the intermediate layer. The inventors of the present invention have discovered that when the subassembly has a diameter of about 1.45 inch to about 1.66 inch and the inner core has a diameter of less than about 0.75 inch, the CoR of the intermediate layer substantially controls the CoR of the subassembly. Preferably, the CoR of the inner core is sufficiently high to compensate for any expected loss of CoR in the specific gravity reduced intermediate layer. The CoR and specific gravity for this subassembly is similar to those listed in the previous tables. The '510 publication is incorporated herein by reference. The CoR, specific gravity, compression and hardness are expected to be in the ranges shown below:

TABLE XI

| | SG-subass'y | Weight (g) Subass'y | CoR | Compression | Hardness (Shore C) |
|---|---|---|---|---|---|
| Control (no microsphere) | 0.96 | 40.4 | 0.831 | 79 | 76 |
| 1% microspheres | 0.95 | 40.2 | 0.827 | 77 | 72 |
| 2% microspheres | 0.86 | 39.3 | 0.795 | 57 | 72 |
| 3% microspheres | 0.81 | 38.8 | 0.784 | 47 | 72 |
| 5% microspheres | 0.65 | 37.2 | 0.726 | 28 | 63 |
| 10% microspheres | 0.48 | 35.5 | 0.612 | 20 | 55 |

Additional materials include the closed-cell foams incorporating microspheres as described in U.S. patent application publication no. 2005/0027025, which is incorporated by reference herein in its entirety. Other exemplary materials that may be used in the golf ball of the present invention are described in U.S. Pat. Nos. 5,824,746 and 6,025,442 and in International application publication no. WO 99/52604, all of which are incorporated by reference herein in their entireties.

In order to achieve a high specific gravity layer, fillers may be added to the inner core or the cover. Some exemplary fillers include, but are not limited to, metal powder, metal flake, metal alloy powder, metal oxide, metal stearates particulates, and/or carbonaceous materials. Other exemplary fillers are described in the '380 patent.

Preferably, the metal powder includes bismuth powder, boron powder, brass powder, bronze powder, cobalt powder, copper powder, nickel-chromium iron metal powder, iron metal powder, molybdenum powder, nickel powder, stainless steel powder, titanium metal powder, zirconium oxide powder, tungsten metal powder, beryllium metal powder, zinc metal powder, and/or tin metal powder. The preferred metal oxide is zinc oxide, iron oxide, aluminum oxide, titanium dioxide, magnesium oxide, zirconium oxide, and/or tungsten trioxide. Additionally, an exemplary metal flake is an aluminum flake. The most preferred high-density filler is tungsten, tungsten oxide, or tungsten metal powder due to its particularly high specific gravity of about 19.

Other suitable polymers include, but are not limited to:

(1) Polyurethanes, such as those prepared from polyols and diisocyanates or polyisocyanates and those disclosed in U.S. Pat. Nos. 5,334,673 and 6,506,851 and U.S. patent application Ser. No. 10/194,059;

(2) Polyureas, such as those disclosed in U.S. Pat. No. 5,484,870 and U.S. patent application Ser. No. 10/228,311; and (3) Polyurethane-urea hybrids, blends or copolymers comprising urethane or urea segments.

Suitable polyurethane compositions comprise a reaction product of at least one polyisocyanate and at least one curing agent. The curing agent can include, for example, one or more diamines, one or more polyols, or a combination thereof. The polyisocyanate can be combined with one or more polyols to form a prepolymer, which is then combined with the at least one curing agent. Thus, the polyols described herein are suitable for use in one or both components of the polyurethane material, i.e., as part of a prepolymer and in the curing agent. Suitable polyurethanes are described in parent application Ser. No. 11/061,338, which has been incorporated by reference in its entirety.

Any polyisocyanate available to one of ordinary skill in the art is suitable for use according to the invention. Exemplary polyisocyanates include, but are not limited to, 4,4'-diphenylmethane diisocyanate ("MDI"); polymeric MDI; carbodiimide-modified liquid MDI; 4,4'-dicyclohexylmethane diisocyanate ("$H_{12}$MDI"); p-phenylene diisocyanate ("PPDI"); m-phenylene diisocyanate ("MPDI"); toluene diisocyanate ("TDI"); 3,3'-dimethyl-4,4'-biphenylene diisocyanate ("TODI"); isophoronediisocyanate ("IPDI"); hexamethylene diisocyanate ("HDI"); naphthalene diisocyanate ("NDI"); xylene diisocyanate ("XDI"); p-tetramethylxylene diisocyanate ("p-TMXDI"); m-tetramethylxylene diisocyanate ("m-TMXDI"); ethylene diisocyanate; propylene-1,2-diisocyanate; tetramethylene-1,4-diisocyanate; cyclohexyl diisocyanate; 1,6-hexamethylene-diisocyanate ("HDI"); dodecane-1,12-diisocyanate; cyclobutane-1,3-diisocyanate;

cyclohexane-1,3-diisocyanate; cyclohexane-1,4-diisocyanate; 1-isocyanato-3,3,5-trimethyl-5-isocyanatomethylcyclohexane; methyl cyclohexylene diisocyanate; triisocyanate of HDI; triisocyanate of 2,4,4-trimethyl-1,6-hexane diisocyanate ("TMDI"); tetracene diisocyanate; napthalene diisocyanate; anthracene diisocyanate; isocyanurate of toluene diisocyanate; uretdione of hexamethylene diisocyanate; and mixtures thereof. Polyisocyanates are known to those of ordinary skill in the art as having more than one isocyanate group, e.g., di-isocyanate, tri-isocyanate, and tetra-isocyanate. Preferably, the polyisocyanate includes MDI, PPDI, TDI, or a mixture thereof, and more preferably, the polyisocyanate includes MDI. It should be understood that, as used herein, the term "MDI" includes 4,4'-diphenylmethane diisocyanate, polymeric MDI, carbodiimide-modified liquid MDI, and mixtures thereof and, additionally, that the diisocyanate employed may be "low free monomer," understood by one of ordinary skill in the art to have lower levels of "free" monomer isocyanate groups, typically less than about 0.1% free monomer groups. Examples of "low free monomer" diisocyanates include, but are not limited to Low Free Monomer MDI, Low Free Monomer TDI, and Low Free Monomer PPDI.

The at least one polyisocyanate should have less than about 14% unreacted NCO groups. Preferably, the at least one polyisocyanate has no greater than about 7.5% NCO, and more preferably, less than about 7.0%.

Any polyol available to one of ordinary skill in the art is suitable for use according to the invention. Exemplary polyols include, but are not limited to, polyether polyols, hydroxy-terminated polybutadiene (including partially/fully hydrogenated derivatives), polyester polyols, polycaprolactone polyols, and polycarbonate polyols. In one preferred embodiment, the polyol includes polyether polyol. Examples include, but are not limited to, polytetramethylene ether glycol ("PTMEG"), polyethylene propylene glycol, polyoxypropylene glycol, and mixtures thereof. The hydrocarbon chain can have saturated or unsaturated bonds and substituted or unsubstituted aromatic and cyclic groups. Preferably, the polyol of the present invention includes PTMEG.

In another embodiment, polyester polyols are included in the polyurethane material. Suitable polyester polyols include, but are not limited to, polyethylene adipate glycol; polybutylene adipate glycol; polyethylene propylene adipate glycol; o-phthalate-1,6-hexanediol; poly(hexamethylene adipate) glycol; and mixtures thereof. The hydrocarbon chain can have saturated or unsaturated bonds, or substituted or unsubstituted aromatic and cyclic groups.

In another embodiment, polycaprolactone polyols are included in the materials of the invention. Suitable polycaprolactone polyols include, but are not limited to, 1,6-hexanediol-initiated polycaprolactone, diethylene glycol initiated polycaprolactone, trimethylol propane initiated polycaprolactone, neopentyl glycol initiated polycaprolactone, 1,4-butanediol-initiated polycaprolactone, and mixtures thereof. The hydrocarbon chain can have saturated or unsaturated bonds, or substituted or unsubstituted aromatic and cyclic groups.

In yet another embodiment, the polycarbonate polyols are included in the polyurethane material of the invention. Suitable polycarbonates include, but are not limited to, polyphthalate carbonate and poly(hexamethylene carbonate) glycol. The hydrocarbon chain can have saturated or unsaturated bonds, or substituted or unsubstituted aromatic and cyclic groups. In one embodiment, the molecular weight of the polyol is from about 200 to about 4000.

Polyamine curatives are also suitable for use in the polyurethane composition of the invention and have been found to improve cut, shear, and impact resistance of the resultant balls. Preferred polyamine curatives include, but are not limited to, 3,5-dimethylthio-2,4-toluenediamine and isomers thereof; 3,5-diethyltoluene-2,4-diamine and isomers thereof, such as 3,5-diethyltoluene-2,6-diamine; 4,4'-bis-(sec-butylamino)-diphenylmethane; 1,4-bis-(sec-butylamino)-benzene, 4,4'-methylene-bis-(2-chloroaniline); 4,4'-methylene-bis-(3-chloro-2,6-diethylaniline) ("MCDEA"); polytetramethyleneoxide-di-p-aminobenzoate; N,N'-dialkyl-diamino diphenyl methane; p,p'-methylene dianiline ("MDA"); m-phenylenediamine ("MPDA"); 4,4'-methylene-bis-(2-chloroaniline) ("MOCA"); 4,4'-methylene-bis-(2,6-diethylaniline) ("MDEA"); 4,4'-methylene-bis-(2,3-dichloroaniline) ("MDCA"); 4,4'-diamino-3,3'-diethyl-5,5'-dimethyl diphenylmethane; 2,2', 3,3'-tetrachloro diamino diphenylmethane; trimethylene glycol di-p-aminobenzoate; and mixtures thereof. Preferably, the curing agent of the present invention includes 3,5-dimethylthio-2,4-toluenediamine and isomers thereof, such as ETHACURE 300, commercially available from Albermarle Corporation of Baton Rouge, La. Suitable polyamine curatives, which include both primary and secondary amines, preferably have molecular weights ranging from about 64 to about 2000.

At least one of a diol, triol, tetraol, or hydroxy-terminated curatives may be added to the aforementioned polyurethane composition. Suitable diol, triol, and tetraol groups include ethylene glycol; diethylene glycol; polyethylene glycol; propylene glycol; polypropylene glycol; lower molecular weight polytetramethylene ether glycol; 1,3-bis(2-hydroxyethoxy) benzene; 1,3-bis-[2-(2-hydroxyethoxy) ethoxy] benzene; 1,3-bis-{2-[2-(2-hydroxyethoxy) ethoxy] ethoxy} benzene; 1,4-butanediol; 1,5-pentanediol; 1,6-hexanediol; resorcinol-di-(β-hydroxyethyl) ether; hydroquinone-di-(β-hydroxyethyl) ether; and mixtures thereof. Preferred hydroxy-terminated curatives include 1,3-bis(2-hydroxyethoxy) benzene; 1,3-bis-[2-(2-hydroxyethoxy) ethoxy] benzene; 1,3-bis-{2-[2-(2-hydroxyethoxy) ethoxy] ethoxy} benzene; 1,4-butanediol, and mixtures thereof. Preferably, the hydroxy-terminated curatives have molecular weights ranging from about 48 to 2000. It should be understood that molecular weight, as used herein, is the absolute weight average molecular weight and would be understood as such by one of ordinary skill in the art.

Both the hydroxy-terminated and amine curatives can include one or more saturated, unsaturated, aromatic, and cyclic groups. Additionally, the hydroxy-terminated and amine curatives can include one or more halogen groups. The polyurethane composition can be formed with a blend or mixture of curing agents. If desired, however, the polyurethane composition may be formed with a single curing agent.

In a preferred embodiment of the present invention, saturated polyurethanes used to form cover layers, preferably the outer cover layer, and may be selected from among both castable thermoset and thermoplastic polyurethanes.

In this embodiment, the saturated polyurethanes of the present invention are substantially free of aromatic groups or moieties. Saturated polyurethanes suitable for use in the invention are a product of a reaction between at least one polyurethane prepolymer and at least one saturated curing agent. The polyurethane prepolymer is a product formed by a reaction between at least one saturated polyol and at least one saturated diisocyanate. As is well known in the art, a catalyst may be employed to promote the reaction between the curing agent and the isocyanate and polyol.

Saturated diisocyanates which can be used include, without limitation, ethylene diisocyanate; propylene-1,2-diisocyanate; tetramethylene-1,4-diisocyanate; 1,6-hexamethylene-diisocyanate ("HDI"); 2,2,4-trimethylhexamethylene diisocyanate; 2,4,4-trimethylhexamethylene diisocyanate; dodecane-1,12-diisocyanate; dicyclohexylmethane diisocyanate; cyclobutane-1,3-diisocyanate; cyclohexane-1,3-diisocyanate; cyclohexane-1,4-diisocyanate; 1-isocyanato-3,3,5-trimethyl-5-isocyanatomethylcyclohexane; isophorone diisocyanate ("IPDI"); methyl cyclohexylene diisocyanate ; triisocyanate of HDI; triisocyanate of 2,2,4-trimethyl-1,6-hexane diisocyanate ("TMDI"). The most preferred saturated diisocyanates are 4,4'-dicyclohexylmethane diisocyanate ("HMDI") and isophorone diisocyanate ("IPDI").

Saturated polyols which are appropriate for use in this invention include without limitation polyether polyols such as polytetramethylene ether glycol and poly(oxypropylene) glycol. Suitable saturated polyester polyols include polyethylene adipate glycol, polyethylene propylene adipate glycol, polybutylene adipate glycol, polycarbonate polyol and ethylene oxide-capped polyoxypropylene diols. Saturated polycaprolactone polyols which are useful in the invention include diethylene glycol-initiated polycaprolactone, 1,4-butanediol-initiated polycaprolactone, 1,6-hexanediol-initiated polycaprolactone; trimethylol propane-initiated polycaprolactone, neopentyl glycol initiated polycaprolactone, and polytetramethylene ether glycol-initiated polycaprolactone. The most preferred saturated polyols are polytetramethylene ether glycol and PTMEG-initiated polycaprolactone.

Suitable saturated curatives include 1,4-butanediol, ethylene glycol, diethylene glycol, polytetramethylene ether glycol, propylene glycol; trimethanolpropane; tetra-(2-hydroxypropyl)-ethylenediamine; isomers and mixtures of isomers of cyclohexyldimethylol, isomers and mixtures of isomers of cyclohexane bis(methylamine); triisopropanolamine; ethylene diamine; diethylene triamine; triethylene tetramine; tetraethylene pentamine; 4,4'-dicyclohexylmethane diamine; 2,2,4-trimethyl-1,6-hexanediamine; 2,4,4-trimethyl-1,6-hexanediamine; diethyleneglycol di-(aminopropyl)ether; 4,4'-bis-(sec-butylamino)-dicyclohexylmethane; 1,2-bis-(sec-butylamino)cyclohexane; 1,4-bis-(sec-butylamino) cyclohexane; isophorone diamine; hexamethylene diamine; propylene diamine; 1-methyl-2,4-cyclohexyl diamine; 1-methyl-2,6-cyclohexyl diamine; 1,3-diaminopropane; dimethylamino propylamine; diethylamino propylamine; imido-bis-propylamine; isomers and mixtures of isomers of diaminocyclohexane; monoethanolamine; diethanolamine; triethanolamine; monoisopropanolamine; and diisopropanolamine. The most preferred saturated curatives are 1,4-butanediol, 1,4-cyclohexyldimethylol and 4,4'-bis-(sec-butylamino)-dicyclohexylmethane.

Alternatively, other suitable polymers include partially or fully neutralized ionomer, metallocene, or other single-site catalyzed polymer, polyester, polyamide, non-ionomeric thermoplastic elastomer, copolyether-esters, copolyether-amides, polycarbonate, polybutadiene, polyisoprene, polystryrene block copolymers (such as styrene-butadiene-styrene), styrene-ethylene-prooylene-styrene, styrene-ethylene-butylene-styrene, and the like, and blends thereof. Thermosetting polyurethanes or polyureas are particularly preferred for the outer cover layers of the golf balls of the present invention.

Additionally, polyurethane can be replaced with or blended with polyurea. Polyurea is fully disclosed in parent application Ser. No. 11/061,338, which has been incorporated herein by reference in its entirety.

The core can be made from a cross-linked rubber. The base rubber typically includes natural or synthetic rubbers. A preferred base rubber is 1,4-polybutadiene having a cis-structure of at least 40%. More preferably, the base rubber comprises high-Mooney-viscosity rubber. If desired, the polybutadiene can also be mixed with other elastomers known in the art such as natural rubber, polyisoprene rubber and/or styrene-butadiene rubber in order to modify the properties of the core. The other layers of the golf ball can also be made from cross-linked rubber.

The crosslinking agent includes a metal salt of an unsaturated fatty acid such as a zinc salt or a magnesium salt of an unsaturated fatty acid having 3 to 8 carbon atoms such as acrylic or methacrylic acid. Suitable cross linking agents include metal salt diacrylates, dimethacrylates and monomethacrylates wherein the metal is magnesium, calcium, zinc, aluminum, sodium, lithium or nickel. The crosslinking agent is present in an amount from about 15 to about 30 parts per hundred of the rubber, preferably in an amount from about 19 to about 25 parts per hundred of the rubber and most preferably having about 20 to 24 parts crosslinking agent per hundred of rubber. The core compositions of the present invention may also include at least one organic or inorganic cis-trans catalyst to convert a portion of the cis- isomer of polybutadiene to the trans-isomer, as desired.

The initiator agent can be any known polymerization initiator which decomposes during the cure cycle. Suitable initiators include peroxide compounds such as dicumyl peroxide, 1,1-di-(t-butylperoxy) 3,3,5-trimethyl cyclohexane, a-a bis-(t-butylperoxy) diisopropylbenzene, 2,5-dimethyl-2,5 di-(t-butylperoxy) hexane or di-t-butyl peroxide and mixtures thereof.

Fillers, any compound or composition that can be used to vary the density and other properties of the core, typically include materials such as tungsten, zinc oxide, barium sulfate, silica, calcium carbonate, zinc carbonate, metals, metal oxides and salts, regrind (recycled core material typically ground to about 30 mesh particle), high-Mooney-viscosity rubber regrind, and the like. Prior to curing or during the curing or cross-linking process, a polybutadiene and/or any other diene comprising rubber or elastomer may be foamed, or filled with hollow microspheres or with expandable microspheres which expand at a set temperature during the curing process to any low specific density level. Cross-linked rubber can be used to form any part of the golf ball, in addition to the core.

The intermediate or cover layer can be made from a relatively rigid polymer, such as ionic copolymers of ethylene and an unsaturated monocarboxylic acid which are available under the trademark SURLYN® of E.I. DuPont de Nemours & Co., of Wilmington, Del., or IOTEK® or ESCOR® of Exxon. These are copolymers or terpolymers of ethylene and methacrylic acid or acrylic acid partially neutralized with salts of zinc, sodium, lithium, magnesium, potassium, calcium, manganese, nickel or the like, in which the salts are the reaction product of an olefin having from 2 to 8 carbon atoms and an unsaturated monocarboxylic acid having 3 to 8 carbon atoms. The carboxylic acid groups of the copolymer may be totally or partially neutralized and might include methacrylic, crotonic, maleic, fumaric or itaconic acid.

Other suitable materials may include one or more homopolymeric or copolymeric, such as:

(1) Vinyl resins, such as those formed by the polymerization of vinyl chloride, or by the copolymerization of vinyl chloride with vinyl acetate, acrylic esters or vinylidene chloride;

(2) Polyolefins, such as polyethylene, polypropylene, polybutylene and copolymers such as ethylene methylacrylate, ethylene ethylacrylate, ethylene vinyl acetate, ethylene methacrylic or ethylene acrylic acid or propylene acrylic acid and copolymers and homopolymers produced using a single-site catalyst or a metallocene catalyst;

(3) Polyurethanes, discussed above;

(4) Polyureas, discussed above;

(5) Polyamides, such as poly(hexamethylene adipamide) and others prepared from diamines and dibasic acids, as well as those from amino acids such as poly(caprolactam), and blends of polyamides with SURLYN®, polyethylene, ethylene copolymers, ethylene-propylene-non-conjugated diene terpolymer, and the like;

(6) Acrylic resins and blends of these resins with poly vinyl chloride, elastomers, and the like;

(7) Thermoplastics, such as urethane; olefinic thermoplastic rubbers, such as blends of polyolefins with ethylene-propylene-non-conjugated diene terpolymer; block copolymers of styrene and butadiene, isoprene or ethylene-butylene rubber; or copoly(ether-amide), such as PEBAX®, sold by ELF Atochem of Philadelphia, Pa.;

(8) Polyphenylene oxide resins or blends of polyphenylene oxide with high impact polystyrene as sold under the trademark NORYL® by General Electric Company of Pittsfield, Mass.;

(9) Thermoplastic polyesters, such as polyethylene terephthalate, polybutylene terephthalate, polyethylene terephthalate/glycol modified, poly(trimethylene terepthalate), and elastomers sold under the trademarks HYTREL® by E.I. DuPont de Nemours & Co. of Wilmington, Del., and LOMOD® by General Electric Company of Pittsfield, Mass.;

(10) Blends and alloys, including polycarbonate with acrylonitrile butadiene styrene, polybutylene terephthalate, polyethylene terephthalate, styrene maleic anhydride, polyethylene, elastomers, and the like, and polyvinyl chloride with acrylonitrile butadiene styrene or ethylene vinyl acetate or other elastomers; and

(11) Blends of thermoplastic rubbers with polyethylene, propylene, polyacetal, nylon, polyesters, cellulose esters, and the like.

Preferably, the intermediate or cover layer includes polymers, such as ethylene, propylene, butene-1 or hexane-1 based homopolymers or copolymers including functional monomers, such as acrylic and methacrylic acid and fully or partially neutralized ionomer resins and their blends, methyl acrylate, methyl methacrylate homopolymers and copolymers, imidized, amino group containing polymers, polycarbonate, reinforced polyamides, polyphenylene oxide, high impact polystyrene, polyether ketone, polysulfone, poly(phenylene sulfide), acrylonitrile-butadiene, acrylic-styrene-acrylonitrile, poly(ethylene terephthalate), poly(butylene terephthalate), poly(vinyl alcohol), poly(tetrafluoroethylene) and their copolymers including functional comonomers, and blends thereof. Suitable cover compositions also include a polyether or polyester thermoplastic urethane, a thermoset polyurethane, a low modulus ionomer, such as acid-containing ethylene copolymer ionomers, including E/X/Y terpolymers where E is ethylene, X is an acrylate or methacrylate-based softening comonomer present in about 0 to 50 weight percent and Y is acrylic or methacrylic acid present in about 5 to 35 weight percent. More preferably, in a low spin rate embodiment designed for maximum distance, the acrylic or methacrylic acid is present in about 16 to 35 weight percent, making the ionomer a high modulus ionomer. In a higher spin embodiment, the inner cover layer includes an ionomer where an acid is present in about 10 to 15 weight percent and includes a softening comonomer. Additionally, high-density polyethylene ("HDPE"), low-density polyethylene ("LDPE"), LLDPE, and homo- and co-polymers of polyolefin are suitable for a variety of golf ball layers.

Other than in the operating examples, or unless otherwise expressly specified, all of the numerical ranges, amounts, values and percentages such as those for amounts of materials and others in the specification may be read as if prefaced by the word "about" even though the term "about" may not expressly appear with the value, amount or range. Accordingly, unless indicated to the contrary, the numerical parameters set forth in the specification and attached claims are approximations that may vary depending upon the desired properties sought to be obtained by the present invention. At the very least, and not as an attempt to limit the application of the doctrine of equivalents to the scope of the claims, each numerical parameter should at least be construed in light of the number of reported significant digits and by applying ordinary rounding techniques.

Notwithstanding that the numerical ranges and parameters setting forth the broad scope of the invention are approximations, the numerical values set forth in the specific examples are reported as precisely as possible. Any numerical value, however, inherently contain certain errors necessarily resulting from the standard deviation found in their respective testing measurements. Furthermore, when numerical ranges of varying scope are set forth herein, it is contemplated that any combination of these values inclusive of the recited values may be used.

What we claim is:

1. A golf ball comprising a cover, a core and at least one intermediate layer positioned between the cover and core layers, wherein the specific gravity of the cover layer is at least 1.5 times the specific gravity of the intermediate layer and further wherein the specific gravity of the intermediate layer is at least 1.5 times the specific gravity of the core, and wherein the cover is a thin dense layer having a specific gravity of at least about 1.5 and a thickness from about 0.001 inch to about 0.050 inch.

2. The golf ball of claim 1, wherein the specific gravity of the cover layer is at least 2.0 times the specific gravity of the intermediate layer and wherein the specific gravity of the intermediate layer is at least 2.0 times the specific gravity of the core.

3. The golf ball of claim 1, wherein the specific gravity of the thin dense layer is at least about 2.0.

4. The golf ball of claim 3, wherein the specific gravity of the thin dense layer is at least about 3.0.

5. The golf ball of claim 1, wherein the thickness of the thin dense layer is from about 0.005 inch to about 0.030 inch.

6. The golf ball of claim 1, wherein the thickness of the thin dense layer is from about 0.010 inch to about 0.020 inch.

* * * * *